United States Patent [19]

Lutz et al.

[11] Patent Number: 4,586,344

[45] Date of Patent: May 6, 1986

[54] REFRIGERATION PROCESS AND APPARATUS

[75] Inventors: Irvin H. Lutz; Jong J. Chen, both of Houston, Tex.

[73] Assignee: DM International Inc., Tulsa, Okla.

[21] Appl. No.: 664,024

[22] Filed: Oct. 23, 1984

[51] Int. Cl.[4] ..... F25B 15/00

[52] U.S. Cl. ..... 62/101; 62/112; 62/331; 62/335; 62/476

[58] Field of Search ..... 62/331, 335, 101, 476, 62/112

[56] References Cited

U.S. PATENT DOCUMENTS 4,374,468 2/1983 Takeshita et al. ..... 62/335 X
4,471,630 9/1984 Sugimoto et al. ..... 62/335 X

OTHER PUBLICATIONS

*Chemical Engineering Thermodynamics,* "Absorption Refrigeration", pp. 308–310 (publication date is prior to Oct. 23, 1983).

*Primary Examiner*—Lloyd L. King
*Attorney, Agent, or Firm*—Bernard, Rothwell & Brown

[57] ABSTRACT

Disclosed is a method and apparatus for refrigeration utilizing a combined mechanical and absorption cycle. Two immiscible or only partly miscible refrigerants are mixed and evaporated in an evaporator to cool a process stream. The refrigerants are separated in an absorber which absorbs one of the refrigerants from the vapor mixture. The non-absorbed refrigerant vapor is compressed and condensed, while the absorbed refrigerant is desorbed and condensed to produce respective liquid refrigerant streams to the evaporator. Optionally the vapor mixture from the evaporator is compressed in a first stage of compression prior to passing to the absorber.

17 Claims, 1 Drawing Figure

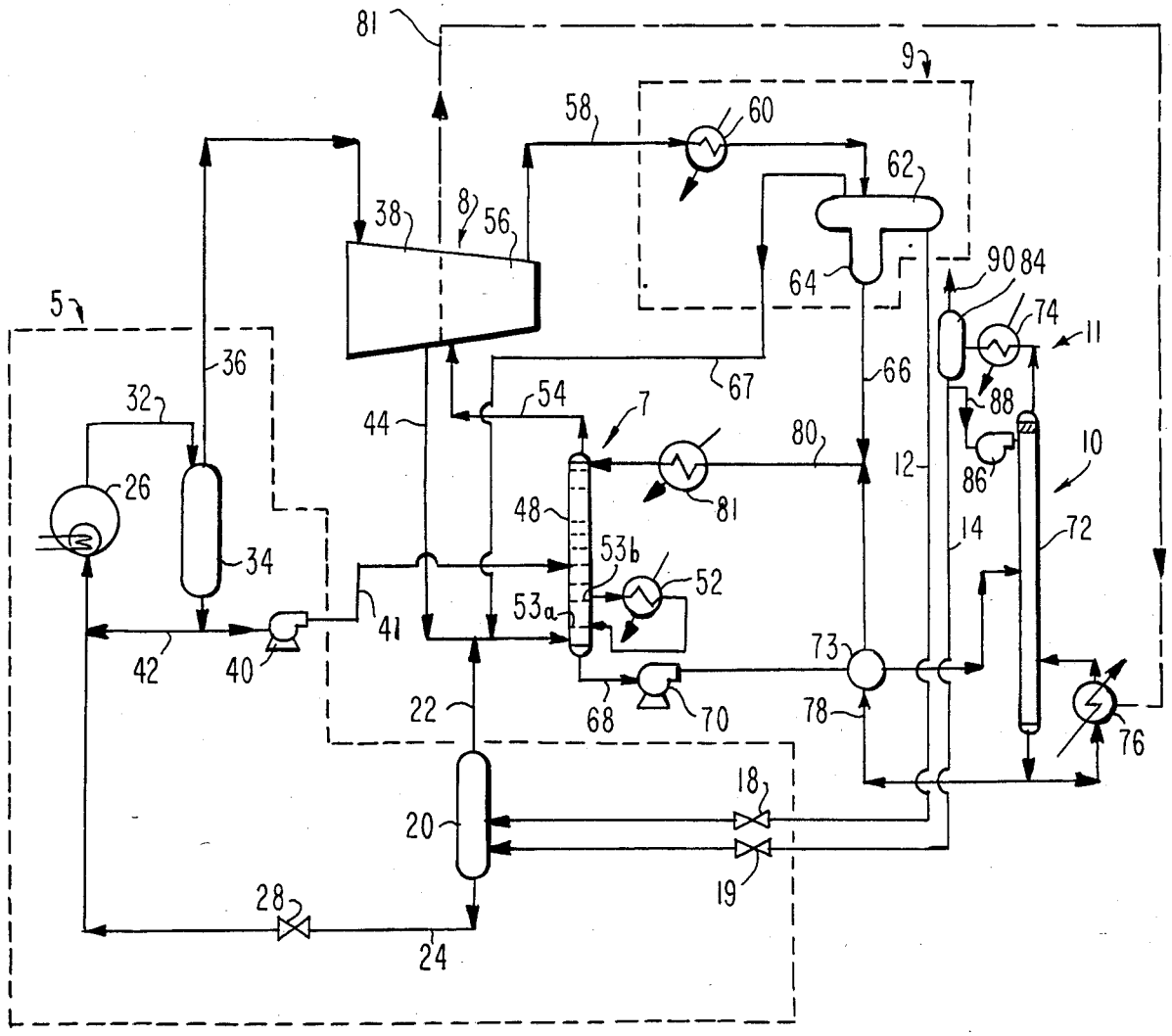
81
9
58
60
62
38
8
56
64
90
84
74
11
5
36
66
67
32
54
7
88
44
80
12
10
26
81
86
48
14
72
34
53b
52
41
53a
42
40
73
22
68
70
78
76
18
20
19
28
24

REFRIGERATION PROCESS AND APPARATUS

TECHNICAL FIELD

The present invention relates to processes and apparatus for refrigeration wherein evaporation and condensation of continuously recycled refrigerants are employed to remove heat of vaporization from the evaporator environment and to discharge heat of condensation to the condenser environment.

BACKGROUND ART

Generally there are two commercial types of evaporation-condensation refrigeration processes known in the art, namely, mechanical refrigeration and absorption refrigeration. In mechanical refrigeration, the low pressure vapor from the evaporator is compressed by a mechanical compressor to the high pressure necessary for condensation into the liquid state by the condenser. In absorption refrigeration, the refrigerant vapor is withdrawn from the evaporator by absorption in a liquid absorbent which is then pumped to a separator or a regenerator where the absorbent is heated to desorb the refrigerant and produce the refrigerant vapor feed for condensation in the condenser. In one prior art absorption refrigeration process there is employed a highly volatile compound, such as hydrogen, producing partial vapor pressures inversely related to the partial vapor pressures of the refrigerant, such as ammonia, in the absorber and regenerator to thus produce about the same total vapor pressure in the absorber and regenerator to eliminate the need for a mechanical pump to feed the absorbent liquid to the regenerator; the total high vapor pressure in the evaporator does not interfere with evaporation of the refrigerant since the partial vapor pressure of the refrigerant in the evaporator is low.

Mechanical and absorption refrigeration processes are utilized in many commercial applications. Absorption refrigeration is particularly attractive when low level waste heat is available for heating the absorbent liquid in desorption of the refrigerant. Mechanical refrigeration is generally preferred for obtaining lower temperatures; a single mechanical refrigeration cycle using propylene refrigerant can practically achieve a −50° F. (−45° C.) temperature, whereas the practical limit for an absorption refrigeration cycle employing ammonia is about −10° F. (−23° C.), although temperatures of −50° F. (−45° C.) are obtainable by increasing the regeneration or desorption temperature from 220° F. (104° C.) to 265° F. (130° C.). Lower refrigeration levels can be obtained using evaporators operating under vacuum; however, this is neither practical nor energy efficient. Below about −50° F. (45° C.), a cascade system, such as a first stage mechanical refrigeration cycle employing propylene to produce a temperature of about −50° F. (−45° C.) and a second mechanical refrigeration stage employing ethylene to produce the temperature below −50° F., is used. In a cascade system, the heat exchange between the stages requires a temperature difference, usually about 10° F. (6° C.) to condense the lower stage refrigerant, thus producing a loss in efficiency.

SUMMARY OF THE INVENTION

The present invention is summarized in a refrigeration process and apparatus utilizing a combination of both mechanical and absorption refrigeration wherein immiscible or only partially miscible mechanical and absorption refrigerants, in liquid state from respective condensers, are fed to an evaporator where the refrigerants evaporate to cool the evaporator environment and form a vapor mixture of the refrigerants. From the evaporator, the mixed refrigerant vapors are fed to an absorber which, by absorption of the absorption refrigerant, separates the two refrigerants. The vapor stream of non-absorbed mechanical refrigerant from the absorber is compressed by a mechanical compressor and fed to its condenser while the sorbent with the absorbed refrigerant is fed to a regenerator where heat desorbs this refrigerant which then passes to its condenser to produce the respective liquid streams of mechanical and absorption refrigerants.

An object of the invention is to provide an improved and more efficient refrigeration process.

Another object of the invention is to increase the evaporation pressure to thus decrease the compression needed to condense a mechanical refrigerant.

One advantage of the invention is that an absorption refrigerant is substantially immiscible or only partially miscible with a mechanical refrigerant and thus can be used to increase total evaporator pressure at the suction inlet to the compressor to reduce the required compressor horsepower.

A further advantage of the invention is that an absorber for an absorption refrigeration cycle effectively separates mechanical and absorption refrigerants.

In one application, there is further featured the use of waste heat from a compressor motor or turbine to provide at least part of the heat needed to desorb the absorption refrigerant from its absorbent in a regenerator.

Other objects, advantages and features of the invention will be apparent from the following description of the best mode taken in conjunction with the accompanying drawing.

BRIEF DESCRIPTION OF THE DRAWING

The drawing is a flow diagram of a preferred embodiment of the invention.

DESCRIPTION OF THE BEST MODE

As shown in the drawing, the invention is embodied in a combined absorption and mechanical refrigeration process and apparatus employing substantially immiscible or only partially miscible absorption and mechanical refrigerants. These refrigerants are evaporated in a common evaporator stage indicated generally at 5 producing refrigeration and forming a vapor mixture which has a total vapor pressure substantially greater than that obtainable when only a single absorption or mechanical refrigerant is employed by itself and nearly equal to the sum of the vapor pressures of each of the refrigerants. From the evaporator 5, the vapor mixture is fed to an absorption stage indicated generally at 7 where absorption and mechanical refrigerants are separated by absorption of the absorption refrigerant in a liquid absorbent. The non-absorbed mechanical refrigerant vapor from the absorber 7 is compressed by a compressor indicated generally at 8 and condensed in a condenser stage indicated generally at 9, while the absorbent with the absorbed refrigerant is passed to a regenerator indicated generally at 10 wherein the absorption refrigerant is desorbed by heat and then condensed in a condenser indicated at 11. The liquid streams 12 and 14 of respective mechanical and absorption refrigerants from the condensers 9 and 11 form the refrigerant feed to the evaporator 5.

The mechanical and absorption refrigerants are immiscible or only partially miscible in the sense that mixtures of the refrigerants have a total vapor pressure which is substantially greater than the vapor pressure of either refrigerant by itself and preferably about equal to the sum of the vapor pressures of the individual refrigerants. The increased vapor pressure in the evaporator 5 results in increased refrigeration efficiency due to a reduction in the compression needed to condense the mechanical refrigerant. It is not necessary that the refrigerants be completely immiscible, and the resultant vapor pressure may be somewhat below the sum of vapor pressures of the individual refrigerants while producing increased efficiency in compression and/or other aspects of the process. Additionally, it is believed that there are some refrigerants which are only partly miscible and which form total vapor pressures greater than the sum of the vapor pressures of the two refrigerants due to the presence of an azeotrope.

The mechanical and absorption refrigerants are also selected in conjunction with the absorbent such that the mechanical refrigerant and the absorption refrigerant are highly insoluble and highly soluble, respectively, in the absorbent at ambient or absorption temperatures. The insolubility and solubility of the respective mechanical and absorption refrigerant vapors in the absorbent is such that substantially complete separation of the mechanical and absorption refrigerants can be achieved in the absorber 7. Separation must be substantially complete to enable condensation of the respective separated mechanical and absorption refrigerant vapors at pressures equal to or only slightly elevated above the pressures necessary to condense these refrigerants if they were pure. Slight elevation in condensation pressures is permissible to the extent that the resultant increase in compression ratio and power requirement for the mechanical refrigerant and any increase in heat requirement for the regenerator do not completely negate the improvement in efficiency resulting from the higher vapor pressure in the evaporater 5 and from the utilization of waste heat from the mechanical compressor motor to desorb the absorption refrigerant in the regenerator.

Examples of suitable mechanical refrigerants include propane, propylene, methane, ethane, ethylene, butane, pentane, various butylenes and pentylenes, and other non-polar hydrocarbons having from 1 to 5 carbon atoms and which are suitable for use as refrigerants. Examples of suitable absorption refrigerants include ammonia, sulfur dioxide, nitrogen dioxide, carbon disulfide, carbon tetrafluoride, carbon tetrachloride, and other polar compounds suitable for use as refrigerants. Absorbents suitable for use in the refrigeration system include water, alcohols having from 1 to 3 carbon atoms, mixtures of water and such alcohols, and other refrigeration absorbents that may be available. The use of alcohols, particularly methanol, can permit a lower level of waste heat to be used in the regeneration of the absorption refrigerant compared to the heat required to regenerate the absorption refrigerant vapor from pure water, due to the lower boiling point of alcohol. For purposes of describing in detail a best mode of the invention, the description particularly refers to a refrigeration process and apparatus utilizing propane as the mechanical refrigerant, ammonia as the absorption refrigerant and water as the absorbent for the ammonia. For other refrigerant and absorbent systems, temperatures and pressures will correspondingly vary.

In the evaporator 5, the essentially pure liquid propane entrance stream 12 and the essentially pure liquid ammonia entrance stream 14 pass through respective expansion valves 18 and 19 into an economizer 20. The expansion valves 18 and 19 provide sufficient reduction in pressure and temperature by partial vaporization to produce a total downstream pressure of the combined refrigerants which is below the pressures in the lines 12 and 14 to maintain the refrigerant flows therein and to produce a desired amount of precooling of the refrigerant stream to the chiller 26. Alternatively, pumps (not shown) can be provided in the liquid refrigerant lines 12 and 14, and the output streams from the pumps can be combined upstream from a single expansion valve in place of valves 18 and 19; these pumps would provide the pressure necessary to maintain the combined stream liquid and to isolate the condensers 60 and 74 from the higher total vapor pressure of the combined liquid refrigerant. Typically, the pressure in the line 12, in the range from 170 to 280 psia (11 to 20 bar), and the pressure in the line 14, in the range from 180 to 300 psia (12 to 21 bar), are reduced to a pressure in the range from about 15 to 100 psia (1 to 7 bar) in the economizer 20, for example, to about 80 psi (5.5 bar). Typically, the entrance streams 12 and 14 at a temperature of about 120° F. (50° C.), are cooled to about 9° F. (−12.5° C.) in the economizer 20. Vapor exits the economizer 20 as stream 22 to the absorber 7.

Liquid refrigerant leaves the economizer 20 as stream 24 which is flashed in chiller 26 by an expansion valve 28. This further reduces the temperature and pressure of the steam 24 entering the chiller to the refrigeration temperature of about −40° F. (−40° C.) and about 26 psia (1.8 bar). Evaporation of both the liquid propane and ammonia components of the stream entering the chiller 26 cools the warmer process stream through heat exchange in the chiller. The refrigerant output 32 of the chiller 26 is passed to an accumulator 34 where any unevaporated liquid refrigerant is separated from the vapor and recycled by stream 42 to the chiller for vaporization. A liquid pump 40 and a line 41 directs a small slip stream from the recycle liquid 42 of the evaporator to the absorber 48; the stream 41, for example, is about 0.5% of the input stream in line 24 to insure that water or other contaminant does not accumulate in the evaporator.

The separated vapor stream 36 is routed to the suction inlet of a first stage 38 of the compressor 8, where it is compressed to a pressure of about 80 psia (5.5 bar) before being passed in stream 44 to the absorber 7. Alternatively, the vapor from the chiller may be fed directly to the absorber and the first stage of the compressor 8 eliminated, or the compressor 8 may include additional stages for compressing the mixed vapor stream to higher pressures. In the described embodiment, one preabsorption compression stage is preferred in order to increase efficiency of the absorption; the number of stages and the pressures are selected to give maximum overall efficiency for the particular design of the refrigeration system.

The compressed vapor stream 44 from the first stage 38 of the compressor is combined with the vapor stream 22 from the economizer 20 to form the feed 46 to an absorption column 48 in the absorber 7. The ammonia in the vapor stream is absorbed by water or methanol flowing countercurrent to the vapor in the absorber 48.

A heat exchanger 52 cooled by circulating cooling water can be included in the absorption column 48 to remove the heat of absorption. Exchanger 52 preferably cools the liquid from plate 53*b* second from the bottom and returns it to the bottom plate 53*a*. Additional heat exchangers, similar to exchanger 52 may be located at different places in the absorber 48 to remove the heat of absorption more efficiently. Alternatively, the ammonia may be absorbed in water in one or more horizontal vessels (not shown), with or without cooling coils. The overhead vapor stream 54 from the absorber comprises almost exclusively the mechanical refrigerant, or propane. Stream 54 is then fed to the second stage 56 of the compressor 8, where it is compressed to a pressure of about 252 psia (17.4 bar). The actual pressure is determined by the cooling medium used to totally condense the compressor discharge stream 58 in the condenser 60. The cooling medium in the condenser 60 can be ambient temperature air or water. Alternatively, the cooling medium can be ammonia-rich water in which case the ammonia vapors released on heating are vented to a lower pressure absorber (not shown). After condensation, stream 58 is fed to an accumulator 62 where essentially pure propane is separated and removed as the evaporator feed stream 12. Any entrained impurity (primarily water) which is immiscible with the propane accumulates in the boot 64 and, by a line 66, is combined with the main solvent flow to the ammonia absorber in line 80. Any non condensed vapor is vented by line 67 back to the absorber input 46.

Essentially all of the ammonia entering the absorption column 48 is absorbed in the liquid absorbent, which is withdrawn in bottoms stream 68. This stream 68, containing from about 30 to 50 weight percent ammonia, is routed to a pump 70 to increase its pressure to above the pressure in the regenerator 10, e.g., about 300 psia (20.7 bar). The stream 68 is then fed to a distillation column 72 in the regenerator; prior to entering the distillation column 72, stream 68 can be passed through a preheater 73 for heat exchange with a bottoms stream 78 from the distillation column to provide increased energy utilization. Distillation column 72 has a bottom reboiler 76 for heating the absorbent to desorb a substantial portion of the ammonia. Advantageously, the heat energy requirement of the reboiler 76 can be supplied entirely, or at least partly, by the exhaust heat, as indicated by the long and short dashed line 81, of the drive motor or turbine (not shown) for the compressor 8. The bottom stream 78 from the distillation column 72, after passing through the heat exchanger 73, is combined with the stream 66 into stream 80 which is passed through heat exchanger 81 cooled by water to the top of the absorption column 48 for absorbing the ammonia from the evaporator vapor stream.

In the ammonia condenser system 11, the vapor stream from the distillation column 72 is passed to a condenser 74 which is cooled by heat exchange with an appropriate medium such as water, air, etc., to operate in an essentially total condensing mode. The output of the condenser 74 passes to an accumulater 84 from which the liquid ammonia stream 14 for the evaporator is taken. A reflux stream for the distillation column 72 is withdrawn from the stream 14 by a pump 86 in line 88. Any traces of vapor are vented in line 90 back to the absorber input or to one of the inputs of the compressor 8. The condensing system 11, and particularly the degree of cooling and condensation, determine the operating pressure of the distillation column 72. Typically this pressure may be in the range from about 100 to about 300 psia (6.8 to 21 bar).

The amount of ammonia desorbed by the separator 72, and the corresponding amount of ammonia remaining in the absorbent stream 78, are determined by the operating pressure and the level of heat in the distillation column 72. The amount of ammonia in the stream 80 and the operating pressure within the absorption column 48, in turn, determine the quantity of ammonia which is desorbed from the evaporator output vapor stream. It is desirable to maximize the amount of ammonia absorption in the column 48 as well as to operate the column 48 at a minimum pressure so as to reduce the load on the compressor 8. The amount of water or other absorbent used, or the rate of flow thereof, also effects the efficiency of the overall refrigeration system. Using a higher pressure in the absorption column 48 to increase the amount of ammonia absorbed in the water minimizes the required amount or rate of flow of water and reduces the heat needed for ammonia distillation in the distillation column 72. Thus, in addition to varying temperature, pressure and other process requirements for utilization of different mechanical and absorption refrigerants and absorbents, the optimum process conditions, including the temperatures and pressures in the absorber 48 and regenerator 72, will vary in accordance with the refrigeration load and the type and cost of energy sources utilized to drive the compressor 8 and to heat the absorbent in the regenerator 10.

The following example demonstrates the performance of a combined mechanical and absorption refrigeration system utilizing the process arrangement shown in the drawing.

EXAMPLE

A single refrigerant level process (−40° F. and 1 MMBTU/HR) employing both propane-rich and ammonia-rich refrigerants has the following material balance in seven selected streams which have the same numbers as the corresponding streams in the drawing. Water is used as the absorption solvent. The condensing temperature of both propane-rich and ammonia-rich refrigerants are assumed to be 120° F. using ambient air.

| STREAM NO. FLOW, LB/HR | 12 | 14 | 22 | 24 | 36 | 54 | 80 |
|---|---|---|---|---|---|---|---|
| PROPANE | 4881.5 | 0.1 | 1264.2 | 3617.4 | 3617.4 | 4881.5 | — |
| AMMONIA | 0.3 | 1374.1 | 443.0 | 931.4 | 931.4 | 2.5 | 118.8 |
| WATER | 2.7 | 1.4 | 0.1 | 4.0 | 0.1 | 21.5 | 2258.0 |
| TEMPERATURE, °F. | 120.0 | 120.0 | 9.3 | 9.3 | −40.0 | 100.0 | 110.0 |
| PRESSURE, PSIA | 243.5 | 285.9 | 80.0 | 80.0 | 25.6 | 75.0 | 280.0 |

One advantage of the combination of mechanical and absorption refrigeration process and apparatus described above, is that the compressor duty can be substantially reduced over that required in the prior art. This is done by providing the increased pressure at the compressor intake due to the higher vapor pressure resulting from the common evaporation of immiscible refrigerants. In the example given for a mechanical refrigerant of propane and an absorption refrigerant of ammonia, the input pressure to the compressor is increased to about 26 psia (1.8 bar) compared to a refrigeration system employing only propane wherein the evaporator pressure and compressor input pressure is about 15 psia (1 bar). Thus, the compressor and the present combined mechanical and absorption refrigeration compresses the propane from about 26 psia (1.8 bar) to about 252 psia (17.4 bar) for a compression ratio of about 10:1 compared to the prior art compression of propane from about 15 psia (1 bar) to 252 psia (17.4 bar) for a compression ratio of about 17:1. This reduction in compression results in a substantial reduction in the horsepower requirement for the compression cycle. For this example the horsepower requirement of the present combined mechanical and absorption refrigeration is about 150 BHP for a refrigeration capacity of 1 MMBTU/HR at −40° F. compared to a horsepower requirement of about 280 BHP for a similar refrigeration service performed by conventional mechanical propane refrigeration. Similar reductions in horsepower requirements and corresponding improved refrigeration efficiencies can be demonstrated for other combinations of immiscible refrigerants.

Further, the present combined mechanical and absorption refrigeration cycle can achieve practical single stage cooling to a lower temperature than the temperatures obtainable by prior art single stage refrigeration. Utilizing propylene as the mechanical refrigerant and ammonia as the absorption refrigerant in the present cycle permits the attainment of a temperature of −65° F. (−54° C.) whereas prior art single stage mechanical refrigeration utilizing propylene could only attain a temperature of about −50° F. (−45° C.). Thus in applications required temperatures in certain ranges such as from −50° to −65° F. (−45° to −54° C.), the present single stage combined mechanical and absorption refrigeration can be used in place of more expensive two stage refrigeration.

Many variations, modifications and changes may be made to the above described embodiment. In some applications, the combined mechanical and absorption refrigeration may be employed in a refrigeration system including multiple refrigeration levels, or cascaded systems, requiring multiple chillers and multiple absorbers at the corresponding pressures and or temperatures. The embodiment and the variations and modifications thereof described above and shown in the drawing are only illustrative of one of many possible embodiments and a few of many possible variations and modifications that can be made without departing from the scope and/or spirit of the invention as set forth in the following claims.

What is claimed is:

1. A refrigeration process comprising the steps of:

evaporating first and second liquid refrigerants recycled from the below recited condensing step, said evaporating step forming a vapor mixture of the first and second refrigerants, absorbing the first refrigerant from the vapor mixture in a liquid absorbent to separate the first and second refrigerants and to form a second-refrigerant vapor stream, desorbing the first refrigerant by heating the liquid absorbent to generate a first-refrigerant vapor stream, compressing the second-refrigerant vapor stream, and condensing the first-refrigerant vapor stream and the compressed second-refrigerant vapor stream to form the respective first and second liquid refrigerants recycled to the evaporating step.

2. The process of claim 1, wherein the first and second liquid refrigerants are immiscible or only partly miscible, and the mixture in the evaporating step has a vapor pressure substantially greater than either vapor pressure of the individual first and second refrigerants.

3. The process of claim 1, wherein the heating of the liquid absorbent includes the use of waste heat from the compressing step.

4. The process of claim 1, including compressing vapor from the evaporating step in a first stage of a multistage compressor prior to the absorbing step, and wherein the second-refrigerant compressing step is performed in subsequent stages of the compressor.

5. The process of claim 1, wherein the first refrigerant is selected from the group consisting of ammonia, sulfur dioxide, nitrogen dioxide, carbon disulfide, carbon tetrafluoride, carbon tetrachloride, and combinations thereof, and the second refrigerant is one or more hydrocarbons having from 1 to 5 carbon atoms.

6. The process of claim 5, wherein the absorbent is water, an alcohol having from 1 to 3 carbon atoms, or mixtures thereof.

7. The process of claim 6, wherein the first refrigerant is ammonia, the second refrigerant is propane and the absorbent is water.

8. The process of claim 7, wherein the ammonia is absorbed in the water at a pressure optimized for the level of heat used in distilling the ammonia, and the propane is totally condensed using ambient temperature cooling water or air.

9. The process of claim 8, including compressing the mixture of ammonia and propane vapor in a first stage of a multiple stage compressor prior to the absorption step, and wherein the propane is compressed in a final stage of the multistage compressor to a final pressure of about 17.4 bar corresponding to a propane condensing temperature of about 49° C., resulting in a compression ratio of about 10 to 1.

10. A refrigeration apparatus having reduced horsepower requirements, comprising:

a chiller for cooling a process stream or other environment by evaporation of first and second refrigerants to form a vapor mixture of the first and second refrigerants;

an absorber positioned downstream of the chiller for absorbing the first refrigerant from the vapor mixture from the chiller with a liquid absorbent to separate the first refrigerant from the second refrigerant;

a compressor for compressing the non-absorbed second refrigerant from the absorber;

a condenser for condensing the compressed non-absorbed second refrigerant from the compressor to form a second refrigerant liquid stream;

a regenerator for separating the absorbed refrigerant from the liquid absorbent for forming a first-refrigerant vapor stream;

a condenser for condensing the first refrigerant vapor stream to form a first-refrigerant liquid stream; and recycle means for passing the first and second refrigerant liquid streams to the chiller.

11. The apparatus of claim 10, wherein the compressor is two stage, the absorber is positioned between the first and second stages and the first stage compresses the vapor mixture from the chiller.

12. The apparatus of claim 11, wherein the first refrigerant is selected from the group consisting of ammonia, sulfur dioxide, nitrogen dioxide, carbon disulfide, carbon tetrafluoride, carbon tetrachloride and combinations thereof, and the second refrigerant is one or more hydrocarbons having from 1 to 5 carbon atoms.

13. The apparatus of claim 12, wherein the absorbent is water, an alcohol having from 1 to 3 carbon atoms, or mixtures thereof.

14. The apparatus of claim 10, wherein the regenerator includes a distillation column with a reboiler which utilizes waste heat as an energy source.

15. The apparatus of claim 13, wherein the first refrigerant is ammonia, the remaining unabsorbed refrigerant is propane and the solvent is water.

16. The apparatus of claim 10 wherein the recycle means includes respective expansion valve means for the respective first and second refrigerant liquid streams.

17. The apparatus of claim 14 wherein the reboiler includes means for utilizing waste heat from the compressor.

* * * * *